US012715647B2

(12) United States Patent
Zürcher et al.

(10) Patent No.: US 12,715,647 B2
(45) Date of Patent: Aug. 25, 2026

(54) POURING ELEMENT WITH PROTECTIVE CUTTING ELEMENT GUIDE

(71) Applicant: SIG Services AG, Neuhausen am Rheinfall (CH)

(72) Inventors: Remo Zürcher, Frauenfeld (CH); Felix Rigling, Dettighofen (CH)

(73) Assignee: SIG Services AG, Neuhausen am Rheinfall (CH)

( * ) Notice: Subject to any disclaimer, the term of this patent is extended or adjusted under 35 U.S.C. 154(b) by 99 days.

(21) Appl. No.: 18/006,408

(22) PCT Filed: May 19, 2021

(86) PCT No.: PCT/EP2021/063253
§ 371 (c)(1),
(2) Date: Jan. 23, 2023

(87) PCT Pub. No.: WO2022/017662
PCT Pub. Date: Jan. 27, 2022

(65) Prior Publication Data

US 2023/0278748 A1 Sep. 7, 2023

(30) Foreign Application Priority Data

Jul. 24, 2020 (EP) ..... 20020337

(51) Int. Cl.
*B65D 5/74* (2006.01)
*B65D 41/04* (2006.01)

(52) U.S. Cl.
CPC ..... *B65D 5/747* (2013.01); *B65D 41/04* (2013.01)

(58) Field of Classification Search
CPC .. B65D 5/748; B65D 51/226; B65D 2401/15; B65D 51/222; B65D 2251/0093; B65D 2251/0015

(Continued)

(56) References Cited

U.S. PATENT DOCUMENTS 5,020,690 A * 6/1991 Kishikawa ..... B65D 5/748 222/541.2
5,147,070 A * 9/1992 Iwamoto ..... B65D 5/748 222/541.2

(Continued)

FOREIGN PATENT DOCUMENTS

CN 105658531 A 6/2016
CN 109311560 A 2/2019

(Continued)

OTHER PUBLICATIONS

An Office Action/Search Report for related Application No. CN 202110842881.1 dated Oct. 13, 2023.

*Primary Examiner* — Charles P. Cheyney
(74) *Attorney, Agent, or Firm* — The Webb Law Firm

(57) ABSTRACT

A pouring element for a composite package is represented and described, including a main body with a pouring tube and a circumferential fastening flange, a hollow cylindrical cutting element arranged concentrically and guided movably in the pouring tube and a resealable screw cap. The cutting element can be driven for the first opening of the composite package by the screw cap. At least two guide ribs formed on the pouring tube interact correspondingly with transfer means formed internally on the cutting element such that an opening path with an at least a predominantly axial piercing segment in front and followed by a straight rotational segment about the longitudinal axis of the pouring tube. The cutting element is arranged such that it can be guided along the opening path. In order to ensure increased safety when guiding the cutting element, the pouring tube has at least two first safety elements, which, together with the at least two guide ribs, are configured to achieve a guidance on both sides for the transfer means of the cutting element along the piercing and/or rotational segment of the opening path.

9 Claims, 12 Drawing Sheets

(58) Field of Classification Search
USPC ..... 222/81, 83, 83.5
See application file for complete search history.

(56) References Cited

U.S. PATENT DOCUMENTS

| | | | | |
|---|---|---|---|---|
| 5,297,696 | A * | 3/1994 | Bernstein | B65D 5/748 222/89 |
| 6,279,779 | B1 | 8/2001 | Laciacera et al. | |
| 8,505,760 | B2 * | 8/2013 | Ott | B65D 5/748 222/541.6 |
| 8,672,167 | B2 * | 3/2014 | Leuenberger | B65D 5/748 220/267 |
| 10,040,597 | B2 | 8/2018 | Martini et al. | |
| 10,676,261 | B2 * | 6/2020 | Berge | B65D 5/748 |
| 10,752,398 | B2 | 8/2020 | Hauser et al. | |
| 11,718,457 | B2 * | 8/2023 | Berge | B65D 5/748 215/257 |
| 2005/0242113 | A1 * | 11/2005 | Weist | B65D 5/748 222/83.5 |
| 2006/0071000 | A1 * | 4/2006 | Weist | B65D 5/748 220/521 |
| 2007/0278174 | A1 | 12/2007 | Kunz et al. | |
| 2008/0105640 | A1 * | 5/2008 | Ott | B65D 51/22 215/252 |
| 2008/0210745 | A1 * | 9/2008 | Rigling | B65D 5/748 229/125.24 |
| 2012/0181281 | A1 * | 7/2012 | Ott | B65D 5/748 220/277 |
| 2013/0056468 | A1 | 3/2013 | Wolters et al. | |
| 2016/0200491 | A1 * | 7/2016 | Dubach | B65D 51/222 222/83 |
| 2019/0071224 | A1 * | 3/2019 | Berge | B65D 5/748 |
| 2019/0144158 | A1 * | 5/2019 | Hauser | B65D 51/226 222/81 |
| 2019/0193894 | A1 * | 6/2019 | Hauser | B65D 5/748 |
| 2022/0177188 | A1 * | 6/2022 | Minnette | B65D 5/748 |

FOREIGN PATENT DOCUMENTS

| | | | |
|---|---|---|---|
| EP | 0520118 | A1 | 12/1992 |
| EP | 1088765 | A1 | 4/2001 |
| EP | 1513732 | B1 | 3/2006 |
| EP | 1509456 | B1 | 6/2006 |
| JP | 2005533725 | A | 11/2005 |
| WO | 2005073098 | A1 | 8/2005 |
| WO | 2011092002 | A1 | 8/2011 |
| WO | 2015032754 | A1 | 3/2015 |

* cited by examiner

POURING ELEMENT WITH PROTECTIVE CUTTING ELEMENT GUIDE

CROSS-REFERENCE TO RELATED APPLICATIONS

This application is the United States national phase of International Application No. PCT/EP2021/063253 filed May 19, 2021, and claims priority to European Patent Application No. 20020337.0 filed Jul. 24, 2020, the disclosures of which are hereby incorporated by reference in their entirety.

BACKGROUND OF THE INVENTION

Field of the Invention

The invention relates to a pouring element for a composite package, comprising a main body with a pouring tube and a circumferential fastening flange, a hollow cylindrical cutting element arranged concentrically and guided movably in the pouring tube and a resealable screw cap, and the cutting element can be driven for the first opening of the composite package by the screw cap and with at least two guide ribs formed internally on the pouring tube interacting correspondingly with transfer means formed externally on the cutting element such that an opening path is plotted with an at least predominantly axial piercing segment in front and followed by a pure rotational segment about the longitudinal axis of the pouring tube, with the cutting element being arranged such that it can be guided along the opening path.

Description of Related Art

Such pouring elements are applied for simplified handling during pouring and the possibility of resealing composite packages on their gable. The hollow cylindrical cutting element opens the previously gas-tight package for the first time and thus forms a pouring opening, with the screw cap allowing the now open composite package to be resealed. These pouring elements are usually applied by separate machines, either by means of hot melt adhesives or by welding the main body to the outer plastic cover layer. In both variants, the circumferential fastening flange is used for this application process.

The exact layer structure of the composite material can vary depending on requirements, but at least consists of a carrier layer made of cardboard and cover layers made of plastic. In addition, a barrier layer (for example, aluminium, polyamide or ethylene vinyl alcohol copolymer) may be necessary in order to ensure an increased barrier effect against gases for aseptic products and also light for aluminium. Therefore, such composite packages are also referred to as cardboard/plastic composite packages.

Such a composite package is normally produced in one of two types of packaging machines. In the first alternative, an endless web is formed from sterilised composite material into a tube and sealed, after which it is filled with the likewise sterilised filling material and sealed and cut at uniform intervals transversely thereto. The resulting "package pads" are then formed along the pre-folded edges into parallelepipedic packages. The sealing seam formed during transverse sealing in the gable region is usually referred to as a gable seam. The other variant uses blanks made of composite material, which are first formed into package sleeves by sealing the longitudinal seam and then formed on mandrels into unilaterally open package bodies, then sterilised, filled and lastly sealed and finally formed.

As the composite material is extremely difficult to separate thanks to the stable layer structure, the composite package is usually adapted accordingly. The pouring element with its cutting element could be sufficiently stable to easily cut through the entire composite material. However, this is mostly unattractive for cost reasons. It is therefore common to prepare the opening region such that a weakened region is formed there, which is predominantly known in two different embodiments. On the one hand, so-called weakening lines are introduced into the outer layers of the composite material, which enable easier separation in accordance with the geometry and size of the cutting element to be used. On the other hand, the weakened region can be designed as a so-called "laminated hole". The first option has the disadvantage that open carton edges are created, which come into direct contact with the filling material during pouring. This can lead to cardboard fibres in the product as well as taste changes of the same. Therefore, an laminated hole is usually preferred as a solution.

A laminated hole, as further described in the applicant's EP 2 528 731 A1, is formed during composite material production. A hole is punched out in the carton carrier layer so that a local weakening occurs in the composite material after it has been coated with the plastic cover layers. This means that it consists of all the usual layers of the composite material without the cardboard carrier layer missing due to punching: The plastic cover layers, if necessary a barrier layer and, if necessary, further laminating and bonding agents.

EP 1 088 765 A1 describes a generic pouring element. The main body with a pouring tube and a circumferential fastening flange, screw cap and cutting element together form a pouring element, which, when actuated for the first time, separates the laminated hole in a large region and pushes the uncut part of the latter aside in order to create a pouring opening. In this case, the movement of the cutting element is guided via a thread on its outer side in the pouring tube of the main body and is driven by the screw cap. As the cutting element is guided over a thread, the assembly, the composition of the individual components, proves to be complex due to the undercuts of the thread and production in the injection moulding process is only possible with restrictions on the part of material selection and/or tool construction. This restriction to a constant feed in the screw movement of the cutting element leads to a slow insertion into the laminated hole, which in turn means that the cutting element pulls at a correspondingly flat angle over the laminated hole. This in turn favours so-called "PE drawing", with the polyethylene film extending in length in front and between the cutting bodies of the cutting element. A film stretched in this way leads to an unclean or even incomplete opening result.

The problems are solved in EP 1 509 456 B1 and EP 1 513 732 B1 of the applicant by performing a plunge and cut movement which first plunges into a steeply downward or purely axial movement and then transitions into a purely horizontal rotational movement. This is made possible by individual guide ribs on the pouring tube of the main body, which redirect and guide the movement of the cutting element. These guide ribs also make it much easier to assemble the pouring element. This one-sided guidance, in contrast, only allows a relatively insecure and unstable guidance of the cutting element, with it is also being held in the main body due to its hollow cylindrical fit and the forces acting between the screw cap, cutting element and laminated hole. In particular in cases that deviate from the aforementioned process, this form of cutting element guidance therefore offers insufficient safety. Excessive external force on the plastic parts can cause the cutting element to fall out of the intended path or before application on a package, the assembled cutting element could shift, block or even fall out completely in various ways. During the opening process, various incorrect manipulations can also cause the cutting element to tilt.

SUMMARY OF THE INVENTION

Based on this, the object underlying the present invention is to design and further develop the pouring element mentioned at the outset and previously described in more detail in such a way that the described disadvantages are overcome. The aim is to increase safety: On the one hand, the known and desired opening behaviour should be ensured when handling the pouring element as intended, but the function should also be maintained in any case in the event of mishandling on the part of the consumer. In particular, the cutting element must be prevented from detaching and falling out of the main element and possibly being swallowed as a result.

This object is achieved in the case of a pouring element with the features of the preamble of claim 1 by the pouring tube having at least two first safety elements, which, together with the at least two guide ribs, are configured to achieve a guidance on both sides for the transfer means of the cutting element along the piercing and/or rotational segment of the opening path. These first safety elements can additionally secure the movement of the cutting element during the opening process, which may prevent undesired shifting or tilting of the cutting element.

Since the transfer means can no longer move freely on one side in the main body, for example unscrewing of the screw cap of a lock that has not yet been fully opened can at least not bring the cutting element into unintentional positions. Even in the case excessive force application on the pouring element, the cutting element with the transfer means remains in the guide.

A further teaching of the invention envisages each guide rib forming an angle ($\alpha$) of 90° to 120°, preferably 90°, to a plane perpendicular to the longitudinal axis of the pouring tube. A rib is a longitudinally formed reinforcement part of a component construction, in this case such ribs protrude from the inner wall of the pouring tube of the main body in order to guide the cutting element. The angle is therefore also measured on the side edge of the rib, which guides the corresponding guide means of the cutting element. The special case of an angle of 90° corresponds exactly to the statements from EP 1 513 732 B1 of the applicant already mentioned and also to the exemplary embodiment explained in more detail here.

In further advantageous embodiments, the first guide means are formed as at least two transfer ribs, which extend in a first section in the circumferential direction. An extension in the circumferential direction in the horizontal, i.e. if the package and the pouring element are arranged flat, of these transfer ribs is used for safe guiding during the pure rotation or on the pure rotational segment of the opening path. During the piercing movement, in contrast, the front side of these transfer ribs runs along the corresponding guide rib.

A further embodiment of the invention envisages each transfer rib having a height measured in the axial direction which is 90 to 99% of the clear distance measured in the axial direction between guide rib and corresponding first safety element. In order for the transfer ribs to be guided as safely as possible in their horizontal rotational movement, the distances should be kept small, with a certain amount of clearance always being necessary so that the transfer ribs guided on both sides do not block or get stuck in an undesirable manner.

According to a further teaching of the invention, the at least two transfer ribs should have a second section at their end located at the front in the direction of rotation, which extends at an angle of 90° to 120°, preferably 90°, away from the first section towards the circumferential fastening flange. Here, in turn, the angle is measured at the leading edge of the rib section and the special case of 90° corresponds to the previously mentioned exemplary embodiment. However, since the second section must be inserted in each case between the guide rib and first safety element during the piercing process, the flanks of the second section are preferably pointing towards one another from top to bottom at a sharp angle. To compensate for this alignment, the averaged angular dimension of the leading and trailing edges can also be used in such a case.

In a further expedient embodiment, the second sections each have a width measured in the circumferential direction, which is 90 to 99% of the clear distance measured in the circumferential direction between the guide rib and corresponding first safety element.

In a further embodiment of the invention, the at least two first safety elements are designed as axially arranged longitudinal ribs and after the opening process, each longitudinal rib is enclosed laterally by two of the at least two horizontal transfer ribs of the cutting element. These longitudinal ribs serve several purposes. On the one hand, they enable the second section to be guided on both sides over a longer piercing path. On the other hand, the respectively next auxiliary element in the direction of rotation, in the case of two simply the other, offers a stop point for the transfer means or the second sections thereof after they have completed the rotation in the circumferential direction. The end point of this rotation is of course also defined in other embodiments, but axially arranged longitudinal ribs offer a more stable position.

Another teaching of the invention envisages that the rotational segment of the opening path is additionally downstream of an axial segment. This last movement along the additional axial segment, which ends in the so-called parking position, is normally not carried out until the already opened closure is resealed. The force transfer elements between the screw cap and cutting element move away from one another during the first opening due to their opposite directions of movement, when viewed axially. At the end of the rotational movement in circumferential direction, these force transfer elements can therefore no longer continue to fulfil their function and the cutting element remains in this position for the time being. When resealing, the force transfer elements slide past avoiding the force transfer elements of the cutting element to the inner side and only when opening again is this movement carried out and the cutting element brought into the parking position. In most embodiments, the package is therefore already completely open before this axial segment is entered.

According to a special embodiment, for every three transfer ribs evenly distributed in the circumferential direction as a transfer means, three corresponding guide ribs and three first safety elements are formed. On the one hand, mounting via three evenly distributed points promises increased stability. On the other hand, the number of respective elements also defines the maximum angle of rotation of the horizontal rotational movement of the cutting element. This maximum angle of rotation is defined as (360°/number of elements), i.e. 120° here. This angle of rotation in turn influences how the teeth on the lower edge of the cutting element must be arranged over the circumference in order for the laminated hole to be cut cleanly.

According to a further teaching of the invention, at least one second safety element is attached in a region of the pouring tube located remote from the circumferential fastening flange. In the original position after assembly, the transfer means, which would otherwise only be placed on the at least two guide ribs, are additionally held from above and thus on both sides. This prevents the cutting element from falling out or tilting at various stages of production and use. For example, a cutting element could otherwise fall out again during assembly such that a package with a main element and screw cap would ultimately be delivered, but without a cutting element. Similarly, without second safety elements, the cutting element could tilt in the assembly position and then be blocked during the first opening and/or lie loosely in the main element. Especially when it comes to these further functions, such a second safety element could also be positioned such that the transfer means rest on it. This would still guarantee that the cutting element is centred and thus secured. At least one single second safety element is required to stabilize the cutting element, but in practice the number of guide ribs, transfer means and safety elements are usually identical in each case.

A further teaching of the invention envisages the at least one second safety element is chamfered on at least one side facing away from the circumferential fastening flange. This upper side of the second safety element is not relevant for the function and is therefore designed for simplified assembly such that the cutting element can be introduced from above with as little resistance as possible without having to incorporate a rotation of the cutting element in the assembly process. In the aforementioned case, when the transfer means rest on the at least one second safety element, this teaching of the invention enables the cutting element nevertheless to pass the element on the opening path without disproportionately increasing the opening forces. For this purpose, such a second safety element should also not account for more than approximately 80% of the extension in the radial direction of the at least two guide ribs.

According to a special embodiment, an additional pure rotational segment is upstream of the opening path, with the cutting element being arranged such that it is held securely in an original holding position additionally with the second safety element.

BRIEF DESCRIPTION OF THE DRAWINGS

The invention is explained in more detail in the following with reference to a drawing which simply represents a preferred exemplary embodiment. In the drawing FIG. 3A to 7A show a pouring element according to the invention in perspective view from below in different stages of the opening process, FIG. 3B to 7B show a pouring element according to the invention in view from below in different stages of the opening process and FIG. 3C to 7C show first and second guide means according to the invention as well as safety elements in a projected vertical view.

DESCRIPTION OF THE INVENTION

Figure 1:
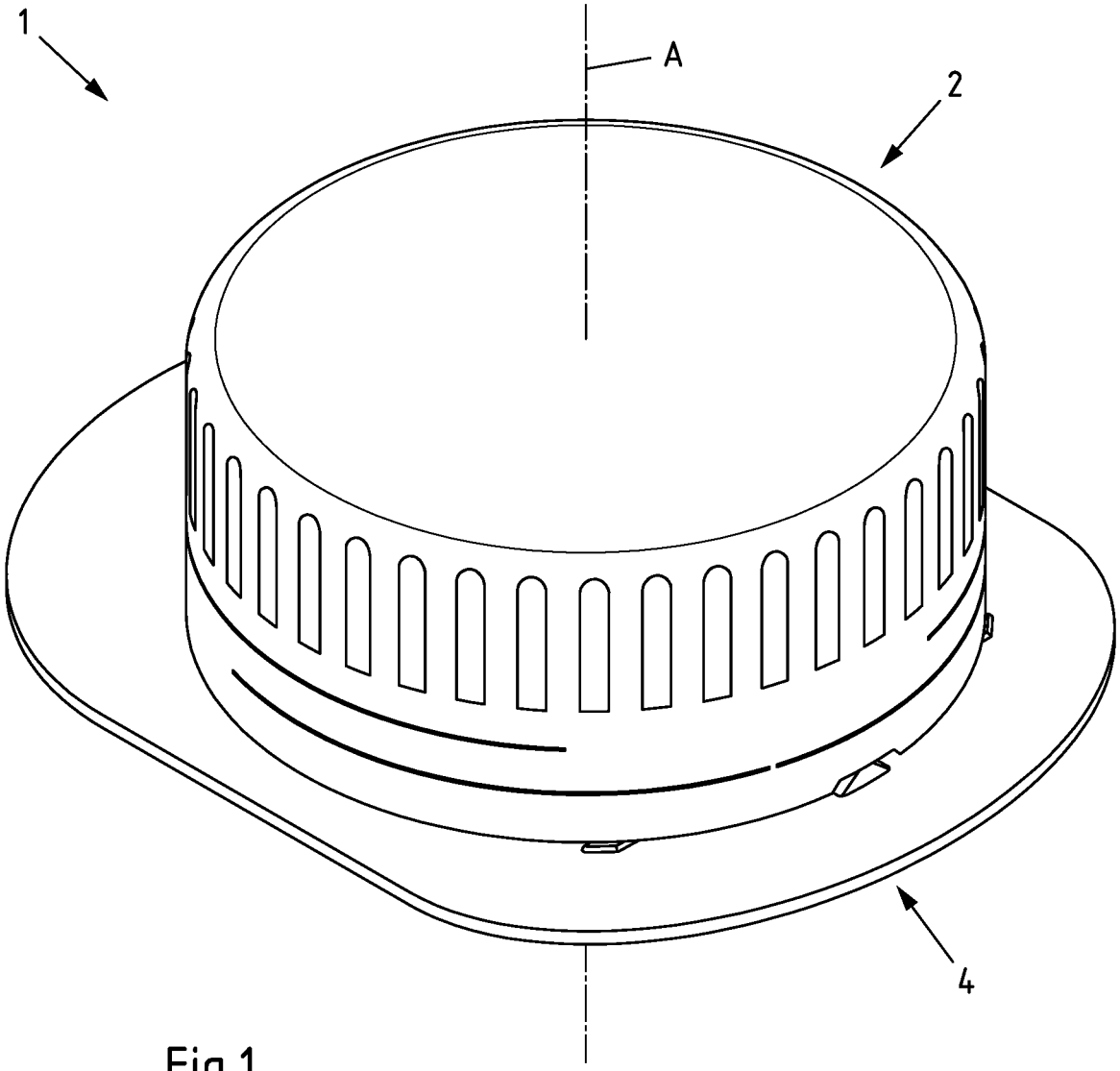
FIG. 1 shows a pouring element according to the invention in a perspective view.

FIG. 1 shows a pouring element 1 according to the invention in a perspective view from the outside. In this case, it is in the assembly position, i.e. as it is also applied on a composite package. The individual components of the pouring element 1 can be seen better in the exploded view of FIG. 2. A screw cap 2 is attached to a main body 4 together with a hollow cylindrical cutting element 3.

Figure 6A:
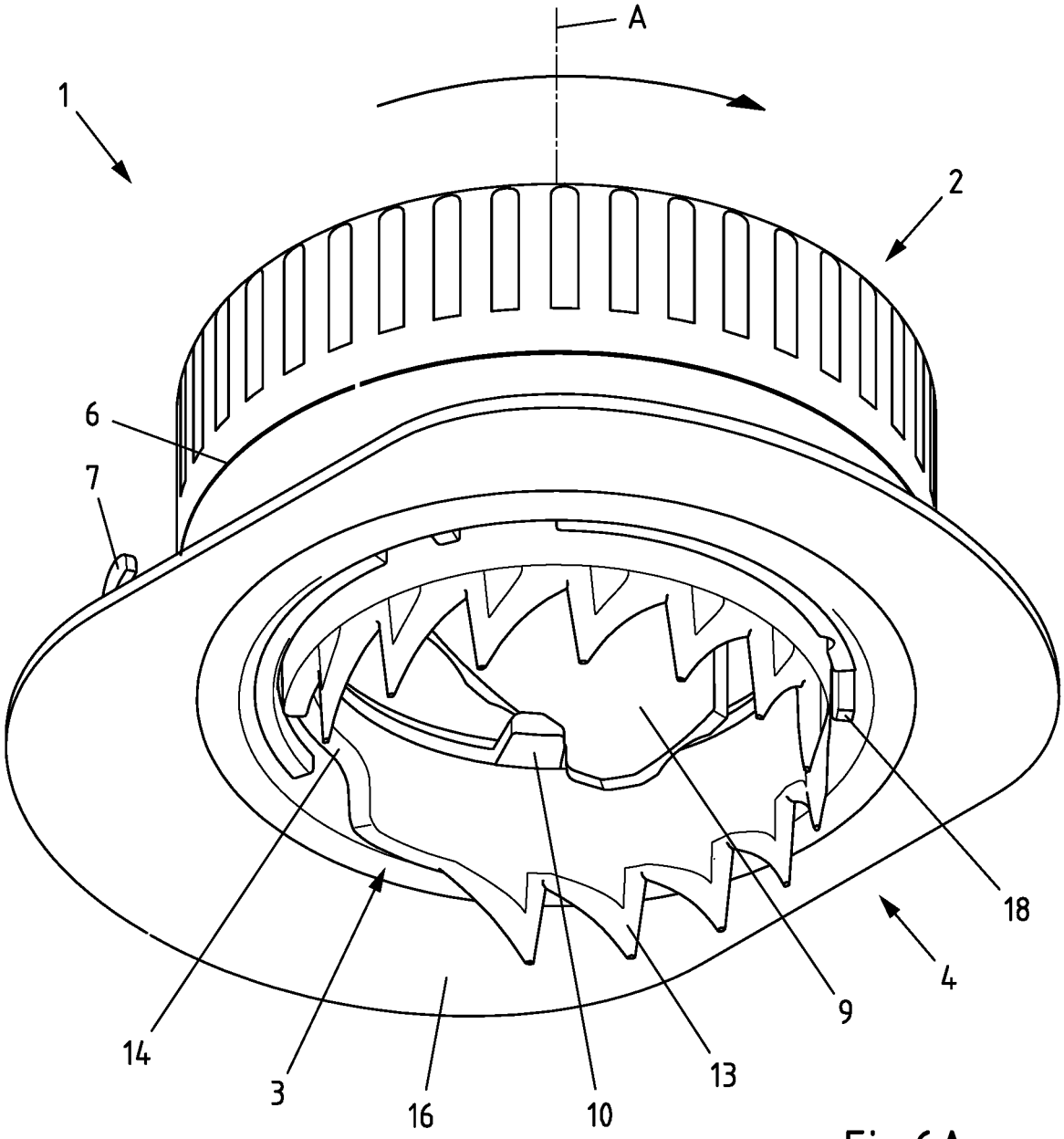
Figure 7A:
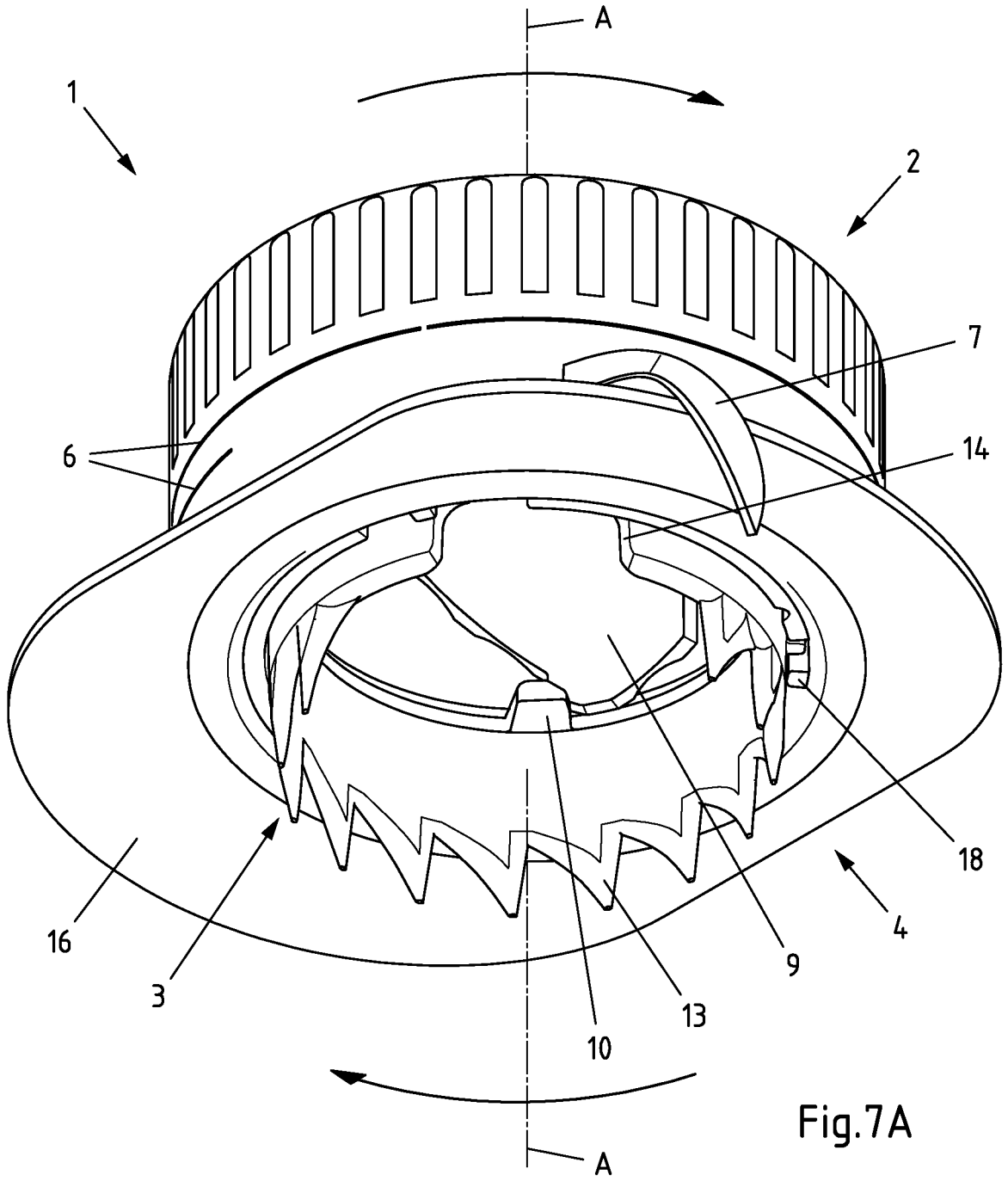

The lower part of the screw cap 2 is designed as an anchor ring 5, which serves to reliably rule out the removal of the screw cap 2 from the main body 4 or a composite package provided therewith after the opening process. For this purpose, screw cap 2 and anchor ring 5 are connected to each other in a hinged manner. This hinge is formed by two weakening zones 6 arranged one above the other, which both span only part of the entire circumference of the screw cap 2 and are usually formed by a plurality of successive cuts. In addition to the weakening zones 6, an indicator element 7 also serves as an authenticity seal, which is designed in such a way that it is already visibly broken before the cutting element 3 has damaged the laminated hole during the piercing process, as can be seen in FIGS. 6A and 7A. This functionality cannot always be guaranteed with weakening zones 6 alone.

Inside the screw cap 2, the thread pitches of the inner thread 8 can be seen, which make it possible to open and close the pouring element 1 via a helical screw movement. Force transfer elements 9, which act on force transfer elements 10 of the cutting element 3 in order to drive the cutting element 3 during the screw movement of the screw cap 2 and move it along the intended path, can also be recognised. The effective area of the force transfer elements 9 comprises a sidewall 9*a* comprising an edge 9*b* which forms an angle of between 30° and 60° to the cap surface 2*a*. This effective angle enables the driving of the cutting element 3 in the piercing and rotational movement. At the lower end of the force transfer elements 9, another section serves to guide the cutting element 3 better during the horizontal rotational movement. The force transfer elements 10 have two corresponding surfaces in order to optimally absorb the force of the rotational movement of the screw cap 2.

On the upper border of the cutting element 3, two of three transfer ribs 11 extending in the circumferential direction are visible, with these transfer ribs in each case having a second section 12 at the end leading in the rotational direction, which is designed at an angle of 90° to the transfer ribs 11. The lower border of the cutting element 3 is equipped with a plurality of, in this exemplary embodiment 12, cutting teeth 13. The cutting teeth 13 have a shape with tips optimised for the piercing process and a cutting edge located at the front in the direction of rotation, which cut open the laminated hole during the pure rotational movement. In addition, the teeth are arranged consecutively such that a notch is created between two cutting teeth 13 in each case, which is able to sever possible longitudinally stretched polyethylene threads that could arise through "PE drawing". The angle region, which is not equipped with cutting teeth 13, must be smaller than the maximum angle of rotation of the cutting element 3 so that the laminated hole can first be cleanly separated and then the unsevered region can be easily pushed aside. In this free region, a residual drainage gap 14 is also formed, which ensures that, after a completely successful opening process and in particular after the first resealing, at least this point of the pouring channel is free of elements protruding into the composite package. This also makes it possible for the last residues of the filling material to be emptied from the composite package through this gap.

In the lowermost part of the exploded view, a pouring tube 15 can be seen and, at the lower border, a circumferential fastening flange 16, which together form the main body 4. In order to fasten the pouring element 1 to a composite package, the circumferential fastening flange 16 is either wetted with an adhesive or welded directly to the outermost plastic layer of the composite package. Guide ribs 17, as well as first and second safety elements 18 and 19 can be seen on the inner wall of the pouring tube according to the invention. The thread pitches of an external thread 20, which serve as a counterpart to the inner thread 8 of the screw cap 2, can in turn be seen on the outside of the pouring tube. On the lower border of the main body 4, a plurality of centring elements 21 are visible, which, on the one hand, additionally centre the cutting element 3 but also form a termination towards the laminated hole. The longitudinal axis A of the pouring tube 15 and hollow cylindrical cutting element 3 can also be seen, which are arranged concentrically. The longitudinal axis A thus also acts as a rotational axis of the rotation of the cutting element 3 during the opening process.

Figure 2:
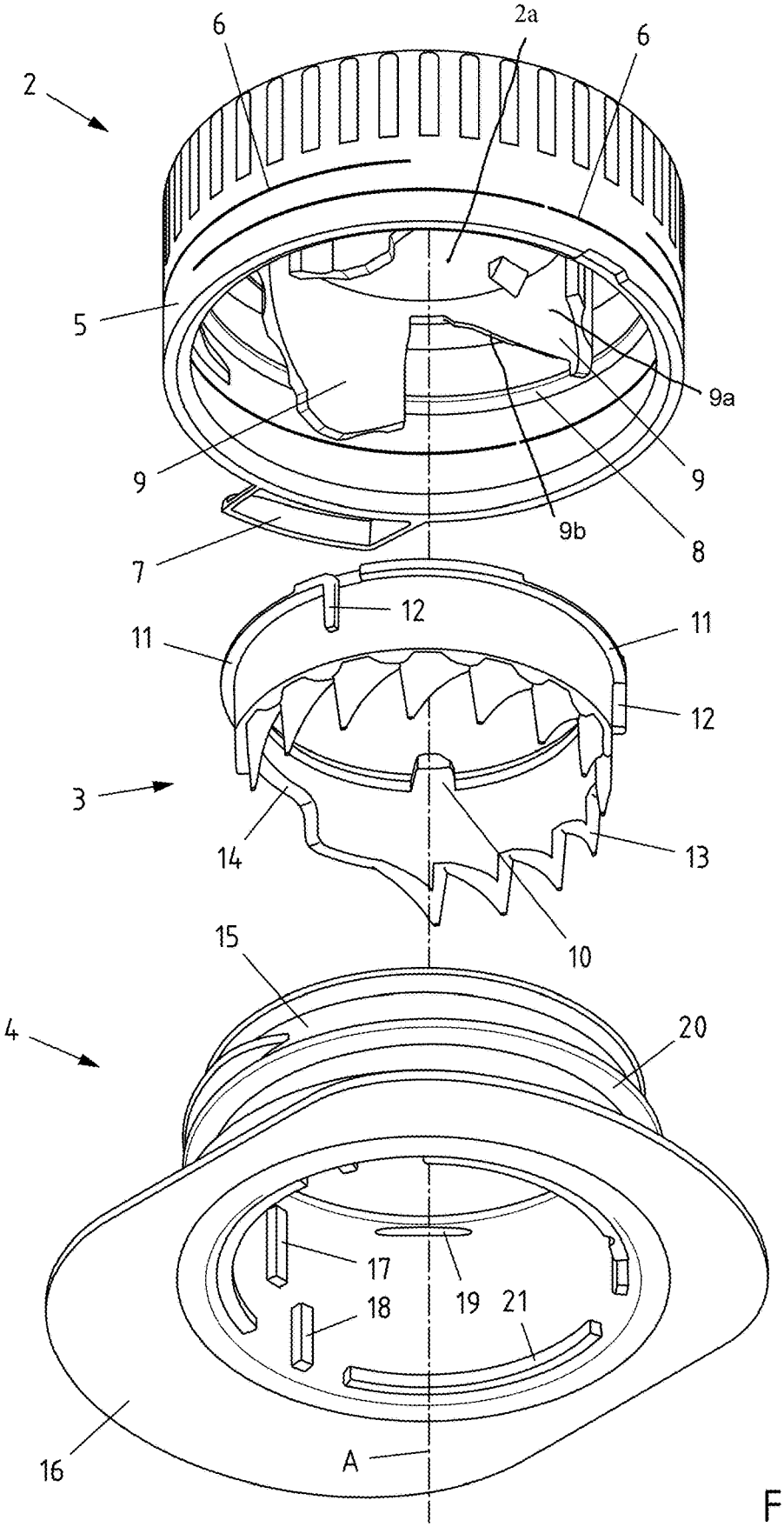
FIG. 2 shows a pouring element according to the invention as an exploded view in perspective view from below.
Figure 3A:
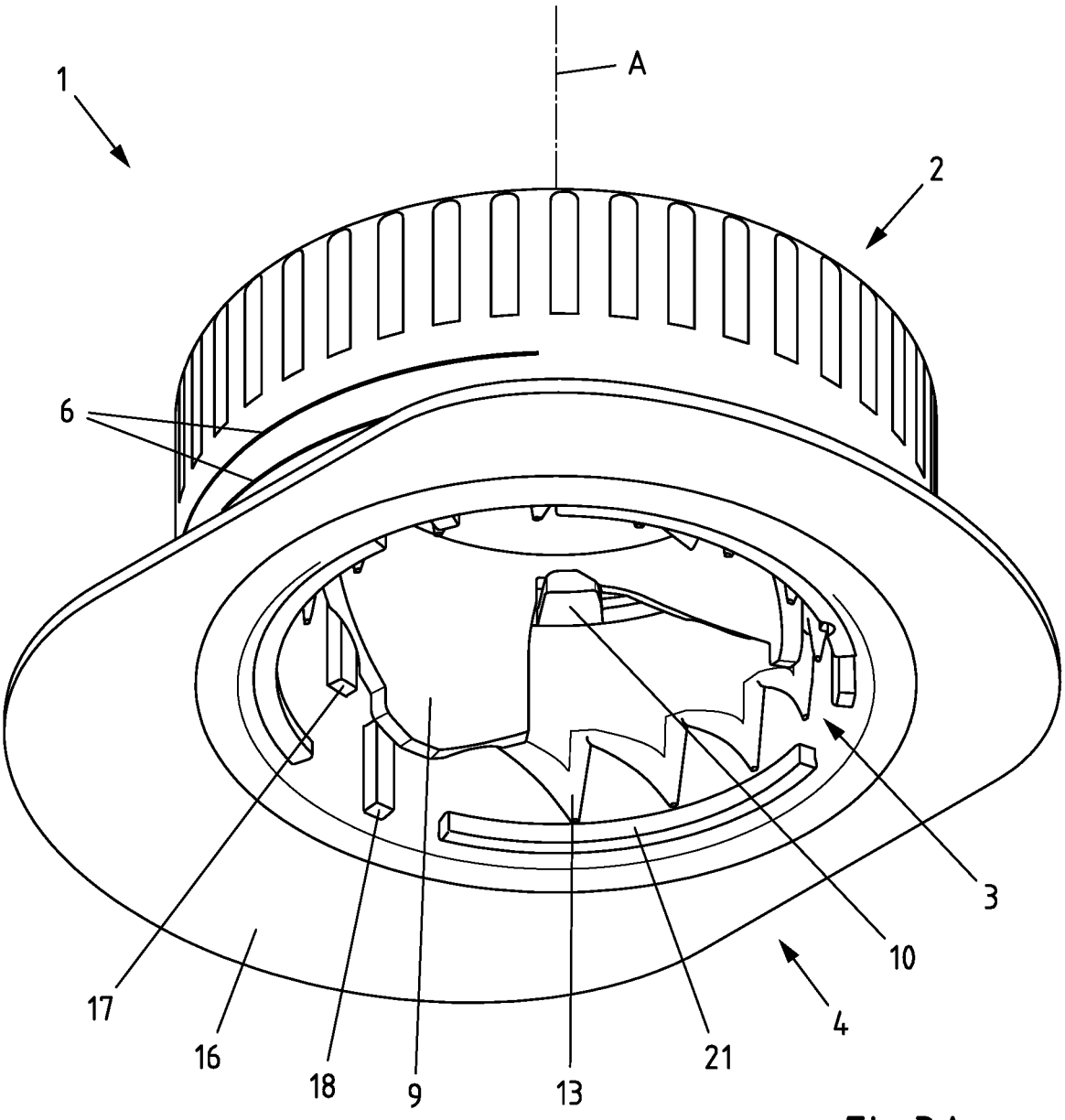
Figure 3B:
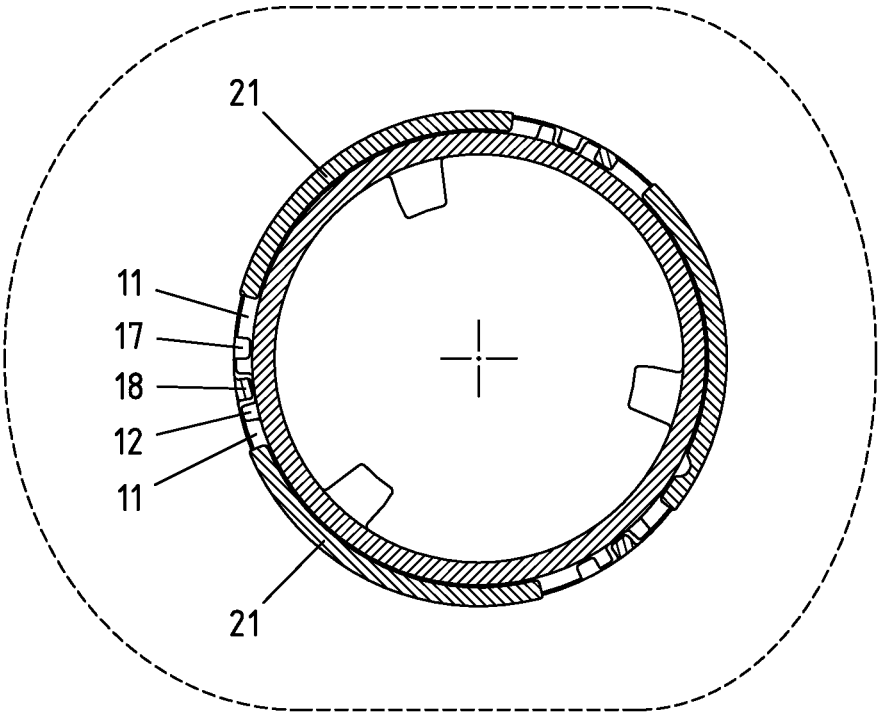

FIG. 3A shows the pouring element 1 in the same perspective view from below as FIG. 2 in the assembled assembly position. It is particularly easy to see here how the force transfer elements 9 and the force transfer elements 10 are joined together. It is also clearly visible that the tooth tips of the cutting teeth 13 of the cutting element 3 maintain sufficient distance from the lower surface of the circumferential fastening flange 16 and thus also from the laminated hole if the pouring element has been applied on a composite package. This in turn prevents accidental premature damage to the laminated hole. FIG. 3B shows the same situation viewed from below, with the force transfer elements 9 of the screw cap 2 being hidden in order to ensure a better overview. The rear ends of the horizontal transfer ribs 11 can be seen here on both sides of the guide ribs 17, since these rest on it and are thus concealed in this view.

Figure 3C:
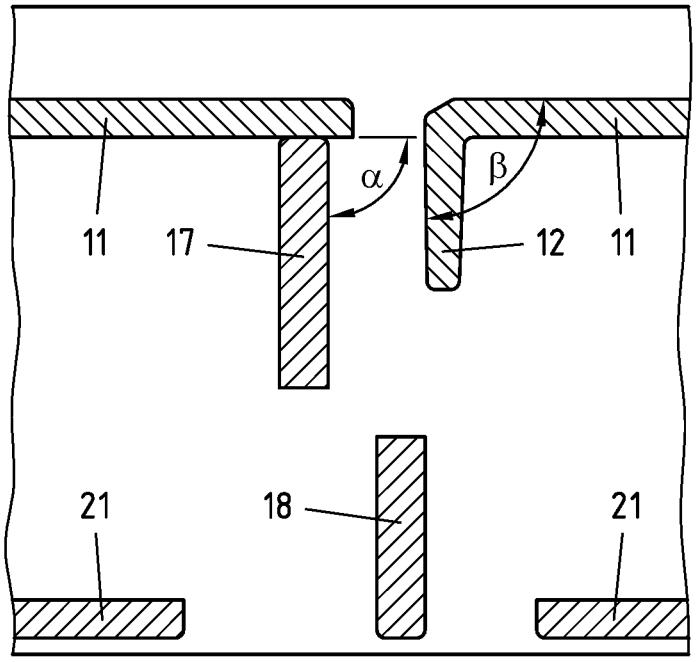

FIG. 3C shows a unwinding of a tube, with only the interacting elements on the inner side of the pouring tube 15 and those on the outer side of the cutting element 3 being drawn. It is for example easy to see that angles $\alpha$, which the guide ribs 17 form with the plane perpendicular to the longitudinal axis A of the pouring tube 15 and angles $\beta$ of the second section 12 correspond. In this exemplary embodiment, both are approximately 90° so that the two ribs can slide along their entire equally aligned surfaces. It can also be seen how the transfer ribs 11 rest on the guide ribs 17 in the assembly position and thus support the cutting element 3 in a stable position. In parallel, the transfer ribs 11 are held in position from above by the second safety elements 19 (not shown here).

Figure 4A:
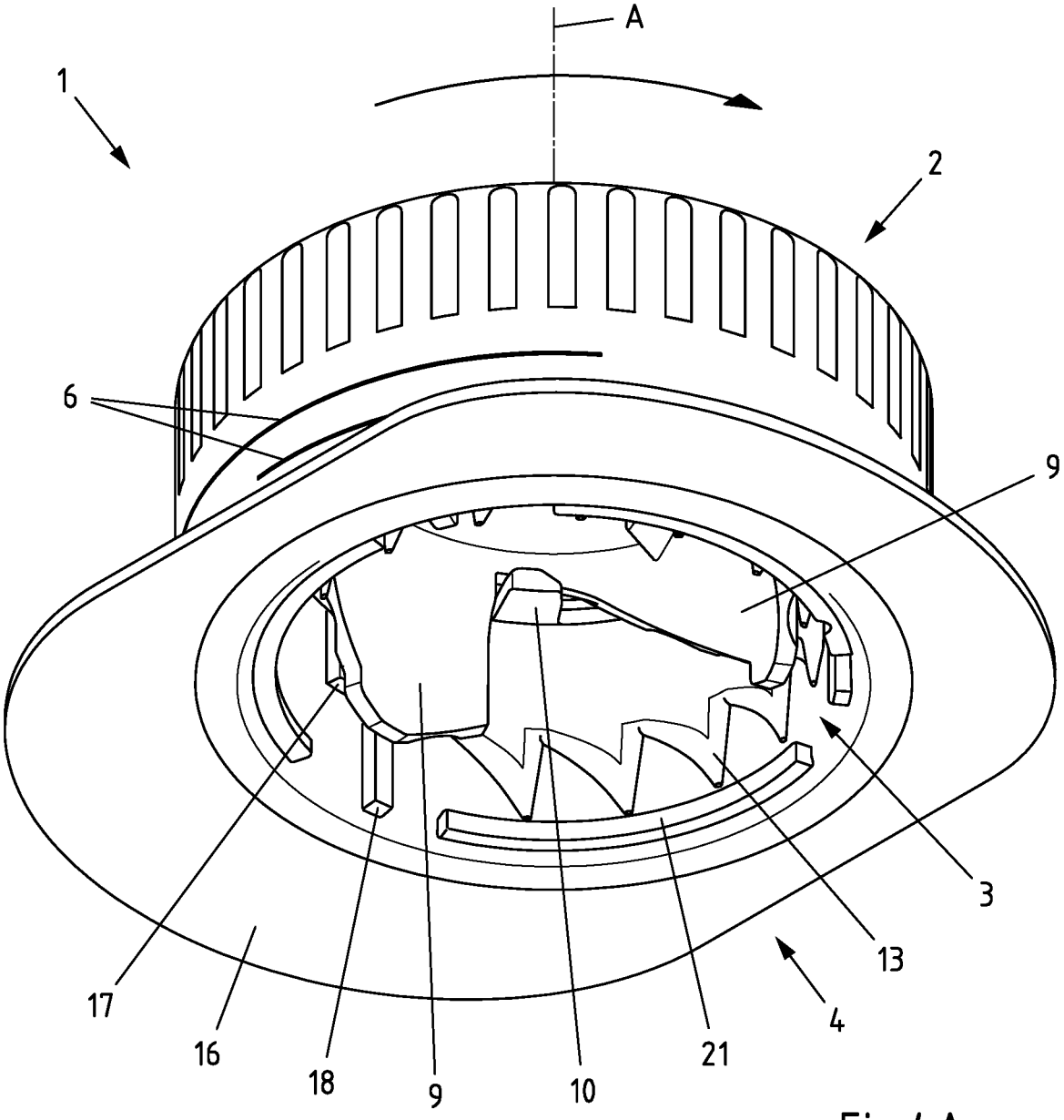
Figure 4B:
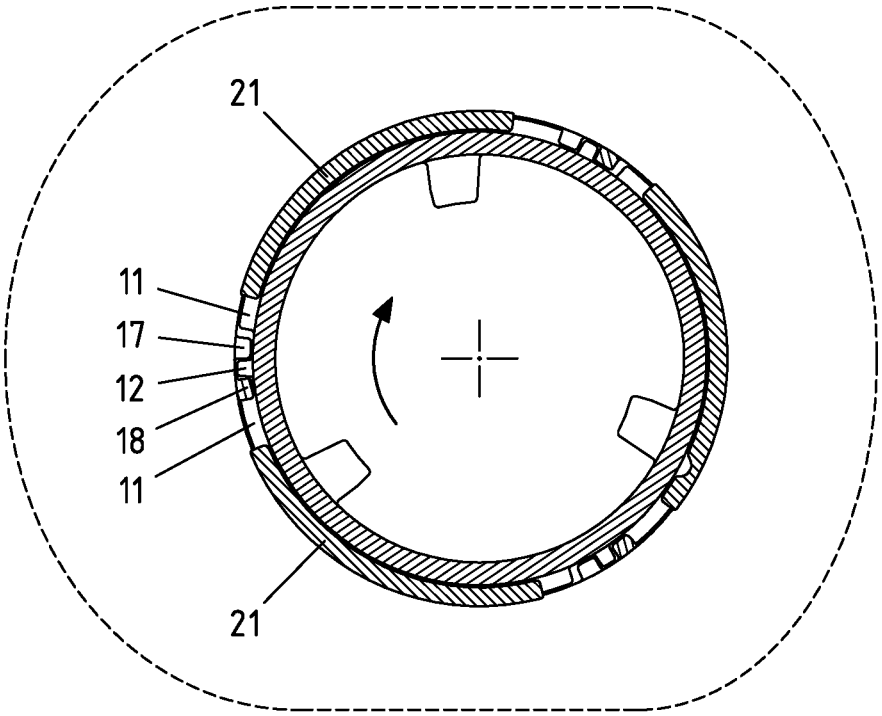
Figure 4C:
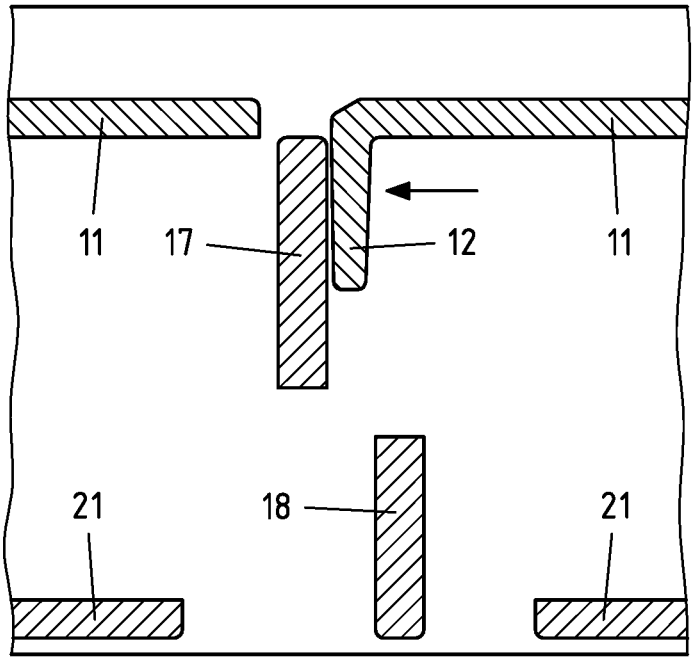

FIG. 4A to 4C show the pouring element at the beginning of the piercing movement, for which screw cap 2 and cutting element 3 must have already been rotated a little in order to leave the original stable position. This rotational movement is marked with arrows in all sub-figures. FIG. 4B indicates how the cutting element 3 has rotated and the transfer ribs 11 now rest on the guide elements 17. FIG. 4C also shows how a second section 12 of the transfer ribs 11 can be guided flat along guide elements 17 even before the first safety elements 18 are engaged. FIGS. 4A and 4B also show the longitudinal axis A of the pouring tube 15 of the pouring element 1, with the piercing movements along this axis and the rotational movements about this axis being carried out as parts of the cutting process.

Figure 5A:
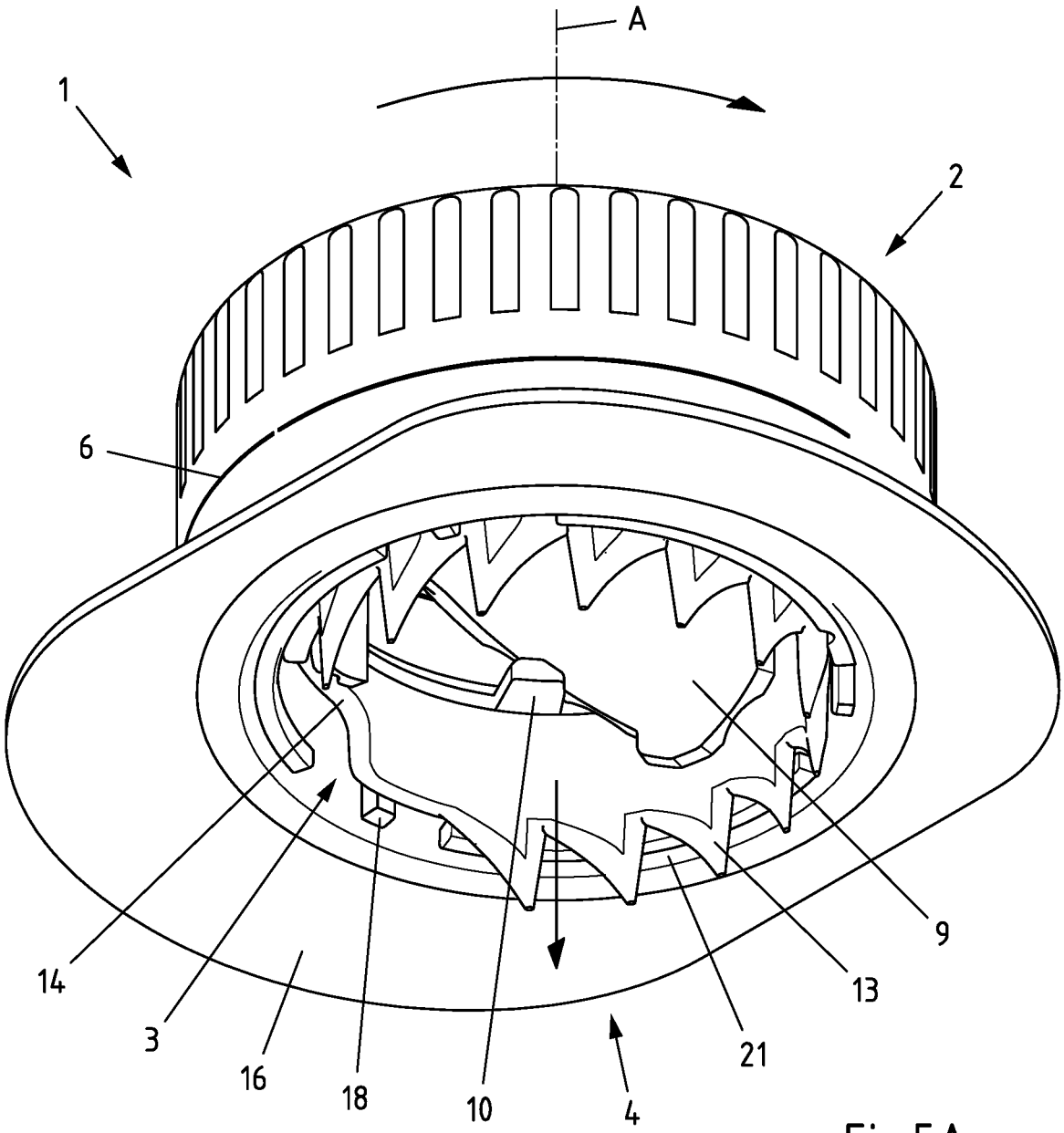
Figure 5B:
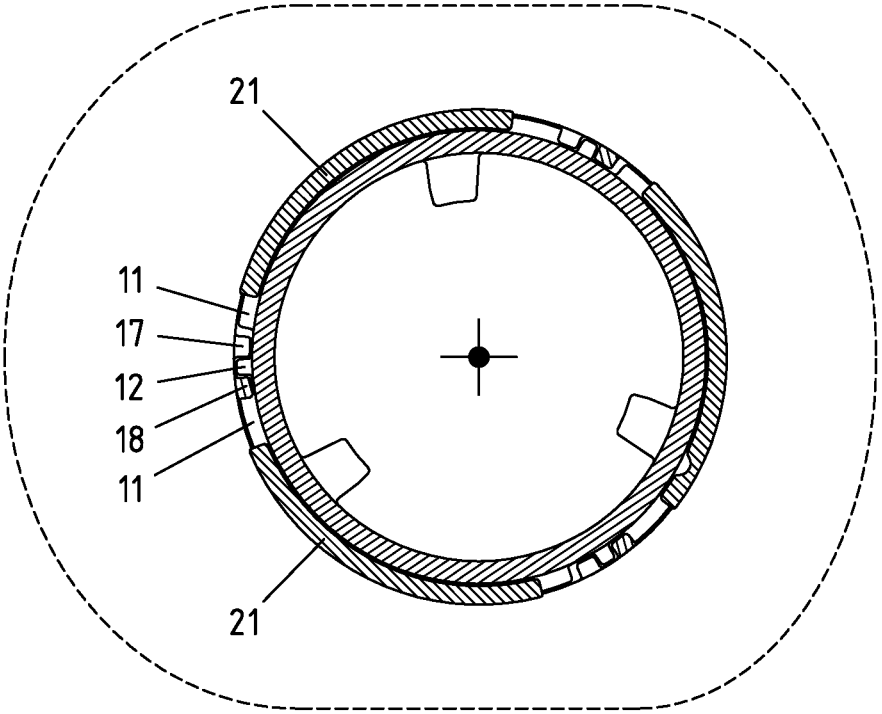
Figure 5C:
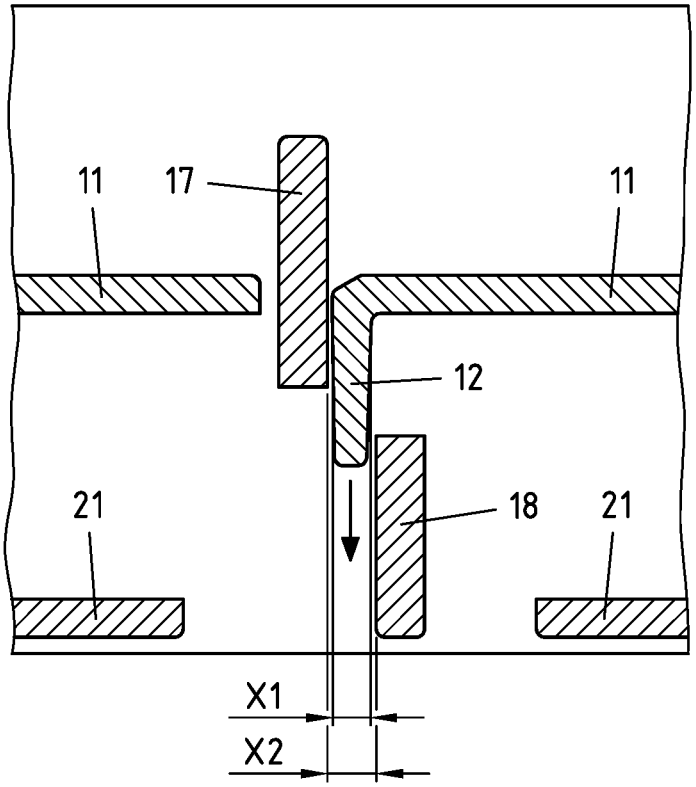

In FIG. 5A to 5C, the piercing movement of the cutting element 3 along the opening path was started by rotating the screw cap 2 further, as shown by the respective direction arrows. Since these two elements are remote from one another, it is easily recognisable how the force transfer elements 9 and the force transfer elements 10 have already advanced in their relative position, although only a small part of the entire opening process has been carried out. It can also be seen how the tooth tips of the cutting teeth 13 would protrude over the lower border of the circumferential flange element 16 and thus pierce the laminated hole in an applied pouring element 1. In the case of angles $\alpha$ and $\beta$ of 90°, as shown in this exemplary embodiment, the views from FIG. 4B to 6B are identical because the cutting element 3 is inserted purely axially. FIG. 5C clearly shows how the second section 12 of the transfer ribs 11 is inserted between the guide rib 17 and the first auxiliary element 18. For this purpose, the width of the second sections 12 measured in the horizontal direction, which was drawn in here as X1, must be smaller than the clear distance of the guide rib 17 and the first safety element 18 also measured in the horizontal direction, which was drawn in as X2. In practice, X1 and X2 should be selected in such a way that the second section 12 is narrowly guided, yet there is still sufficient clearance to enable a clean and problem-free sliding along. It can also be seen here that the legs of the second section 12 run slightly pointed towards one another in order to facilitate insertion in the gap of the width X2.

Figure 6B:
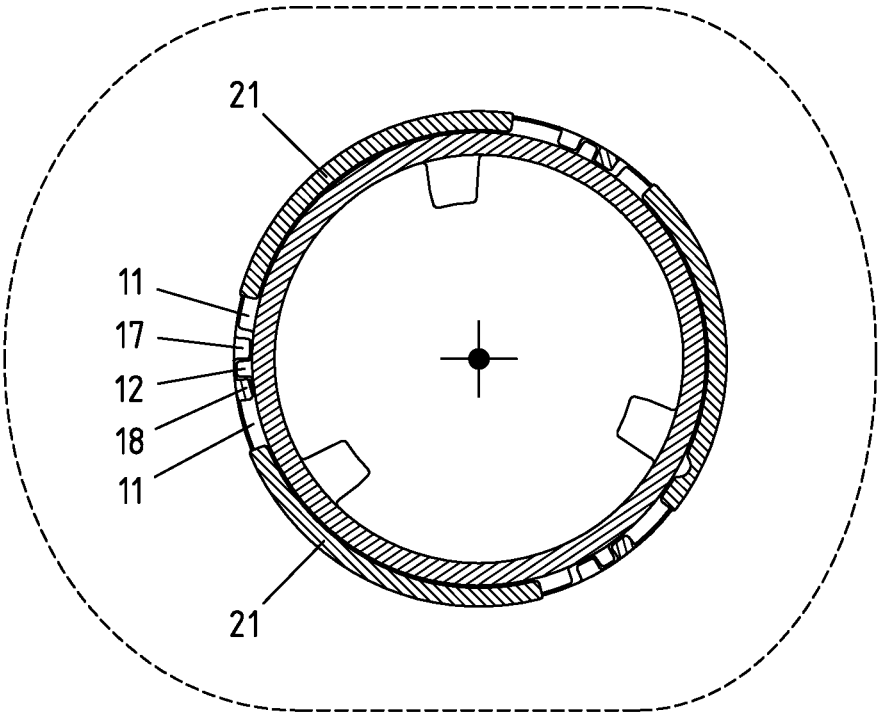
Figure 6C:
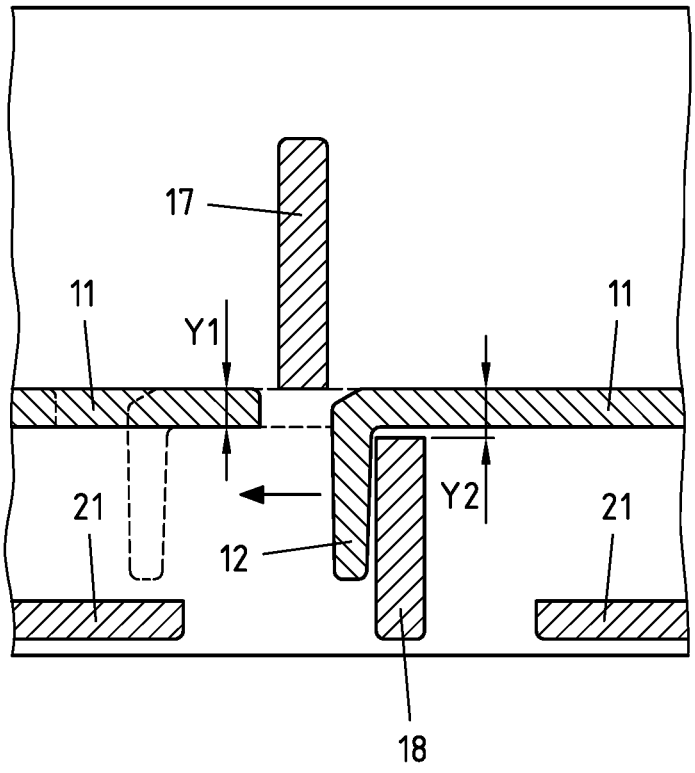

FIG. 6A to 6C show the pouring element 1 at the end of the piercing process and thus at the transition to the horizontal rotational movement. The cutting teeth 13 are now protruding so far that all cutting edges act on the laminated hole (not shown here). Since the laminated hole expands as an elastic layer during piercing, there are usually still polyethylene flakes between different teeth in this position, which are then only severed during the horizontal rotational movement. Between the foremost and rearmost of the cutting teeth 13 is also a continuously undamaged point of the laminated hole, to which the remainder of the laminated hole remains attached so that it can be pushed aside by the cutting element 3. It can also be recognised that the force transfer elements 9 now interact with their lowermost and vertically formed section with the force transfer elements 10. Since from this point only screw cap 2, via the flat unscrewing movement, moves in the axial direction, this vertically formed section is rather small compared to the rest of the force transfer elements 9.

FIG. 6C now shows the second function of the first auxiliary elements 18, since the transfer ribs 11 are visibly guided on both sides during the rotational movement. In the prior art, the cutting element 3 was supported from this point of the cutting process only by the forces acting on the laminated hole from below. The increased safety due to this support function is illustrated here very clearly. It can also be seen how the height Y1 measured in the axial direction can be no greater than the clear distance of the guide rib 17 and the first safety element 18 measured in the axial direction, which is drawn in here with Y2, so that the horizontal rotational movement can be carried out. Here, too, the lengths Y1 and Y2 are selected such that the horizontal transfer ribs 11 are narrowly guided, yet there is still sufficient clearance to enable a clean and problem-free sliding along. A dashed line shows particularly well on the second section 12 how the transfer ribs 11 of the cutting element 3 advance during the course of the rotational movement.

Figure 7B:
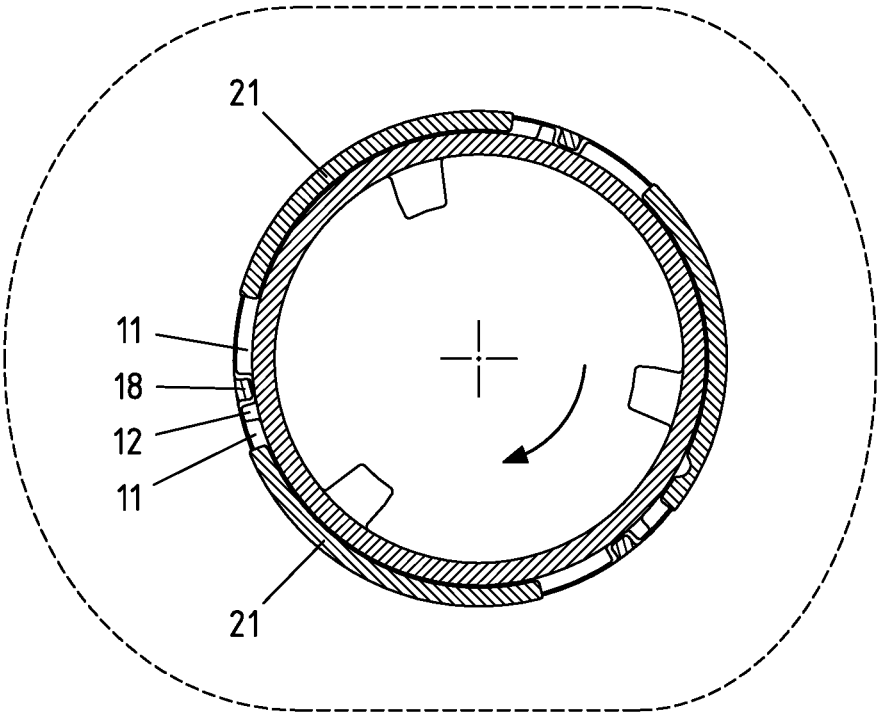
Figure 7C:
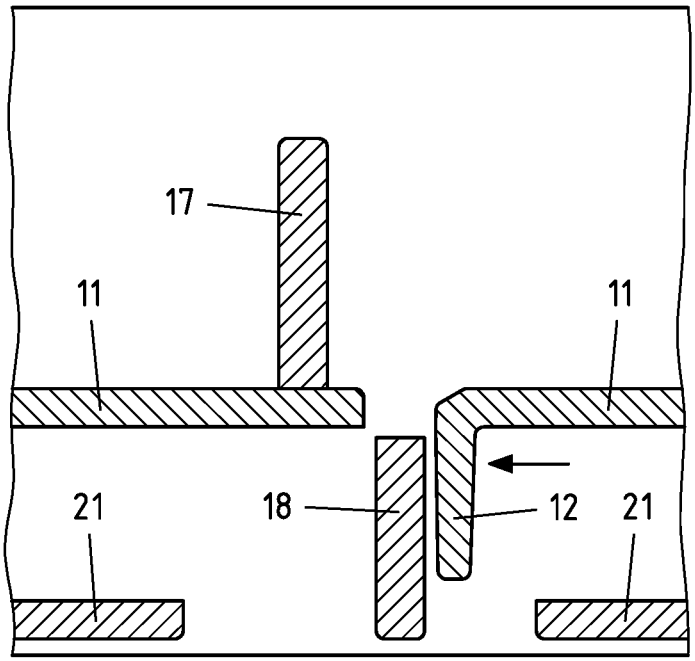

Finally, FIG. 7A shows how the cutting element 3 was rotated roughly 120° about the axis of the pouring element 1. It can also be seen that the screw cap 2 is still unscrewed far enough upwards during the screw movement such that the force transfer elements 9 and the force transfer elements 10 can now be crushed against one another when the cutting element 3 rests on the respective next first safety element 18 through the second sections 12 of the transfer ribs 11, as can be seen in FIGS. 7*b* and 7C. After this crushing, the screw cap 2 no longer comes into direct contact with the cutting element 3 and is only held by the threaded pair between screw cap 2 and main body 4. Depending on the length and pitch of this thread pair, the screw cap 2 will now be unscrewed a different length further. It has been shown that a total rotation of 360° to 450° is considered optimal by the consumer. In this exemplary embodiment, the total rotation of the screw cap 2 is 410°, with the cutting element being driven only over roughly 120° such that a completely open laminated hole can be guaranteed before the screw cap 2 is detached from the main body 4.

It can be easily recognised in FIGS. 7B and 7C that the second section 12 is now in each case on the next first safety element 18, viewed in the direction of rotation. The end position of the cutting element 3 after the first opening is shown here, since roughly from this point the force transfer elements 9 are no longer in active contact with the force transfer elements 10. When the pouring element 1 is resealed, the force transfer elements 9 on the rear side of the force transfer elements 10 are pushed inwards so that they pass by. In the case of reopening, these elements in turn engage with one another and the cutting element 3 is thus displaced once again axially towards the package. Depending on the exact design and arrangement of the various elements, this interruption can naturally occur at a different point between the original movement and the movement during the second opening. Thus, in other embodiments, it would also be possible that part of this second axial movement of the cutting element 3 already occurs during the first opening or that the last part of the rotational movement about the longitudinal axis A is only carried out during reopening.

The invention is not limited to the represented exemplary embodiment, but rather can be expanded to a variety of configurations without departing from the underlying idea of the invention. For this purpose, further preferred embodiments are provided in the dependent claims.

In particular, ribs should not be forgotten in this context. As already mentioned, a rib is a longitudinally formed reinforcement part of a component construction, with such ribs protruding here, for example, from the inner wall of the pouring tube of the main body in order to guide the cutting element. Of course, most functions of this invention can also be fulfilled by, for example, at least two smaller elements protruding from the wall of the pouring tube, which can have different forms and are arranged linearly. In other words, this would be a rib in which gaps have been introduced.

The invention claimed is:

1. A pouring element for a composite package, comprising a main body with a pouring tube and a circumferential fastening flange, a hollow cylindrical cutting element arranged concentrically and guided movably in the pouring tube and a resealable screw cap, wherein the screw cap comprises a cap surface and a force transfer element(s) extending from the cap surface and comprising a sidewall comprising an edge which forms an angle of 30° to 60° to the cap surface and acts on corresponding force transfer element(s) of the cutting element to directly drive the cutting element during the screw movement of the screw cap for the first opening of the composite package by the screw cap and thereby move the cutting element in a piercing and rotational movement along an opening path, wherein the cutting element can be driven for the first opening of the composite package by the screw cap and wherein at least two guide ribs formed internally on the pouring tube interact correspondingly with transfer means formed externally on the cutting element such that an opening path is plotted with an at least a predominantly axial piercing segment in front and followed by a straight rotational segment about the longitudinal axis of the pouring tube, wherein the cutting element is arranged such that it can be guided along the opening path, wherein the pouring tube has at least two first safety elements which, together with the at least two guide ribs, are designed to achieve guidance on both sides for the transfer means of the cutting element along the piercing and/or rotational segment of the opening path, wherein the transfer means on the cutting element comprises at least two transfer ribs which extend in a circumferential direction of the cutting element, and wherein each transfer rib has a height measured in an axial direction, which is 90 to 99% of a distance measured in the axial direction between a first guide rib of the at least two guide ribs and a corresponding first safety element of the at least two first safety elements.

2. The pouring element according to claim 1, wherein the at least two transfer ribs have a second section at their end located at the front in the direction of rotation, which extends at an angle of 90° to 120° away from the first section towards the circumferential fastening flange.

3. The pouring element according to claim 2, wherein the second sections each have a width measured in the circumferential direction, which is 90 to 99% of the clear distance measured in the circumferential direction between the guide rib and corresponding first safety element.

4. The pouring element according to claim 1, wherein the at least two first safety elements are designed as axially arranged longitudinal ribs and after the opening process, each longitudinal rib is enclosed laterally by two of the at least two transfer ribs of the cutting element.

5. The pouring element according to claim 4, wherein the rotational segment of the opening path is additionally downstream of an axial segment.

6. The pouring element according to claim 5, wherein for every three transfer ribs evenly distributed in the circumferential direction as a transfer means, three corresponding guide ribs and three first safety elements are formed.

7. The pouring element according to claim 1, wherein at least one second safety element is attached in a region of the pouring tube remote from the circumferential fastening flange.

8. The pouring element according to claim 7, wherein the at least one second safety element is chamfered on at least one side facing away from the circumferential fastening flange.

9. The pouring element according to claim 7, wherein an additional pure rotational section is upstream of the opening path, wherein the cutting element is arranged such that it is held securely in an original holding position additionally with the second safety element.

* * * * *